United States Patent [19]

Kapusta

[11] Patent Number: 4,681,481

[45] Date of Patent: Jul. 21, 1987

[54] DECORATIVE, FUNCTIONAL ELEMENT FOR CONSTRUCTION AND THE LIKE

[76] Inventor: Janusz J. Kapusta, 1060 Ocean Ave., Apartment D5, Brooklyn, N.Y. 11226

[21] Appl. No.: 738,843

[22] Filed: May 29, 1985

[51] Int. Cl.[4] ..... E01C 5/00

[52] U.S. Cl. ..... 404/34; 404/41; 404/42

[58] Field of Search ..... 404/34, 39, 41, 42; 52/311, 608; D25/80, 92, 93; 428/81, 156, 49, 50

[56] References Cited

U.S. PATENT DOCUMENTS

| | | | |
|---|---|---|---|
| 165,896 | 7/1875 | Von Versen et al. | 404/34 X |
| D. 231,350 | 4/1974 | Ishida et al. | D25/93 |
| 3,229,439 | 1/1966 | Strobel | 404/41 X |
| 3,617,336 | 11/1971 | Gilard | 428/156 |
| 4,133,152 | 1/1979 | Penrose | 52/311 X |
| 4,503,644 | 3/1985 | Coutu, Sr. | 52/608 X |

*Primary Examiner*—James A. Leppink
*Assistant Examiner*—Matthew Smith
*Attorney, Agent, or Firm*—Fred A. Keire

[57] ABSTRACT

As an article of manufacture, a construction element typically in a square configuration for its exposed face, or multiples thereof, suitable as a load bearing or decorative member or a facing or tile for a wall, floor, ceiling and the like, wherein at least one face of the element has a combination of five exposed surfaces, which surfaces interrelate and give varied visual effects by the interplay of light with the five exposed surfaces.

12 Claims, 28 Drawing Figures

FIG. 1
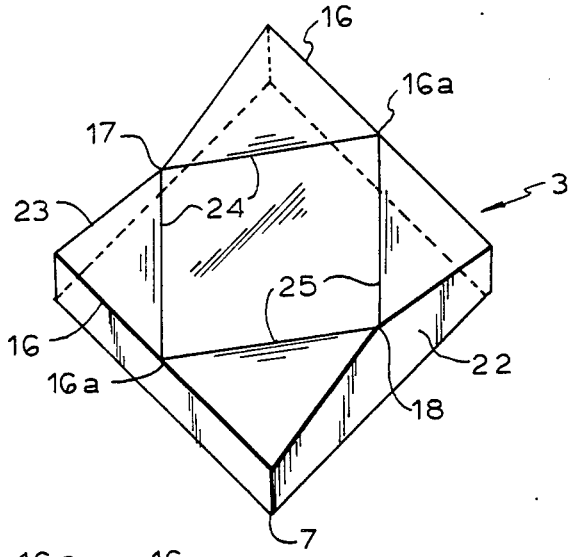
FIG. 3
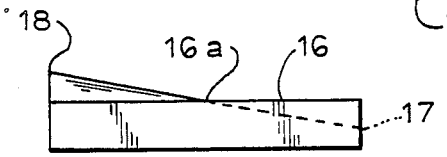
FIG. 5
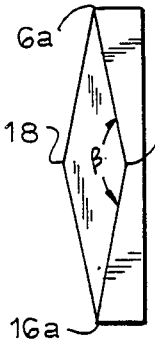
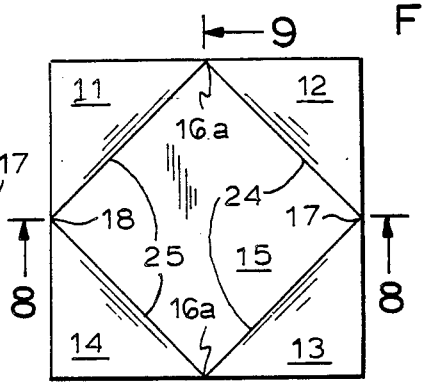
FIG. 2
FIG. 6
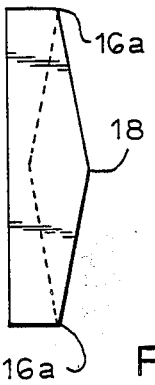
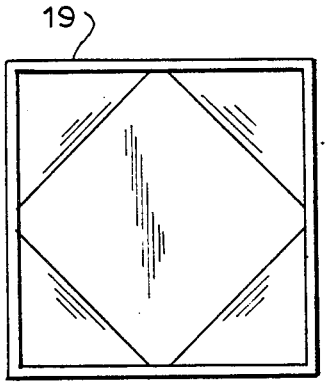
FIG. 7
FIG. 4
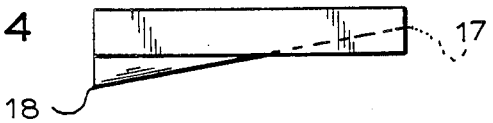
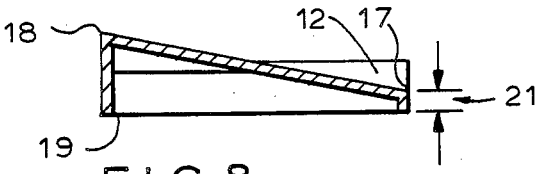
FIG. 8
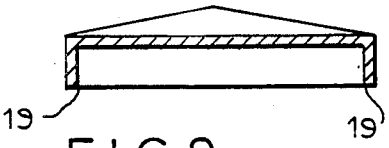
FIG. 9

$\alpha = 0° \rightarrow 90°$ EQ. = EQUAL $\beta = >180 \rightarrow <90$

FIG. 13
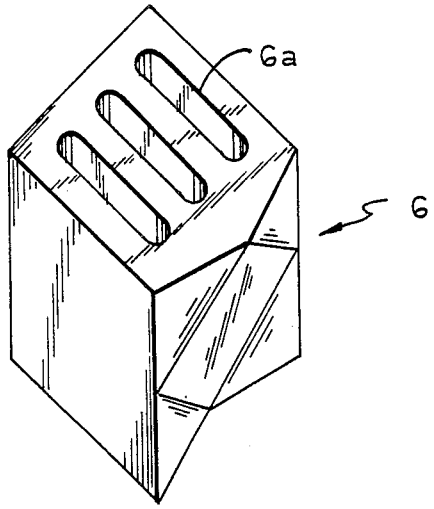
FIG. 15
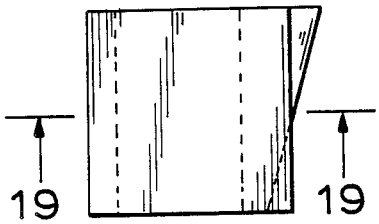
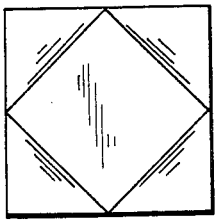
FIG. 16
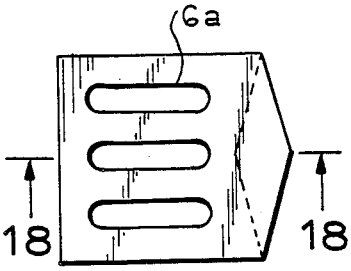
FIG. 14
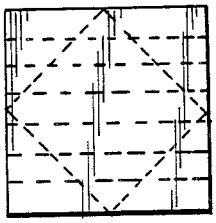
FIG. 17
FIG. 18
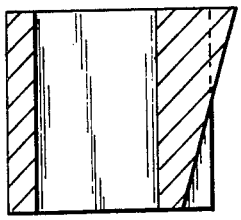
FIG. 19
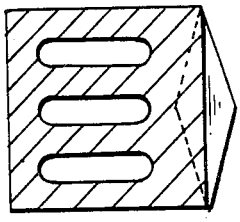

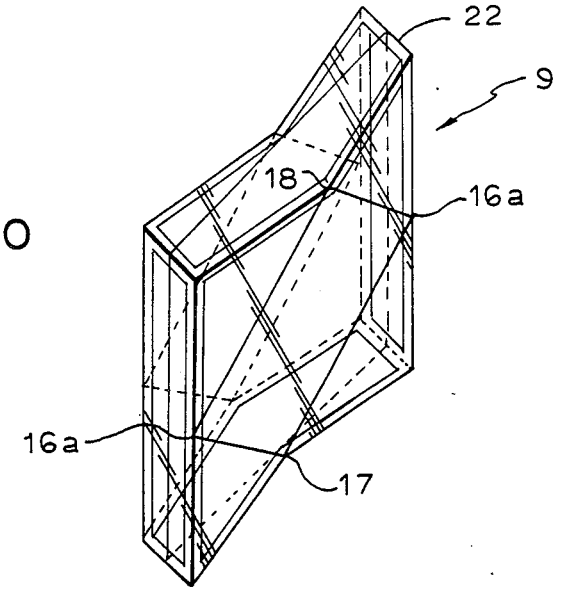
FIG. 20
FIG. 24
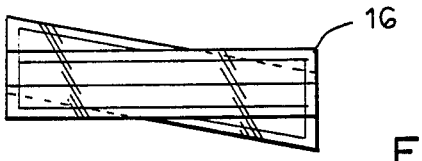
FIG. 22
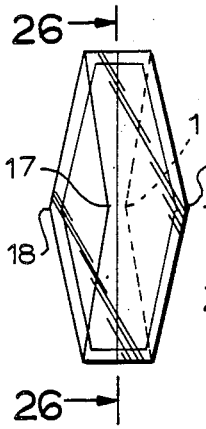
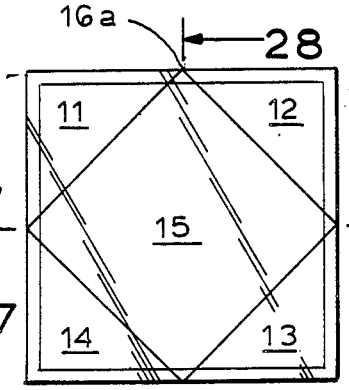
FIG. 21
FIG. 23
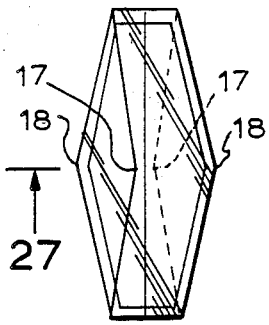
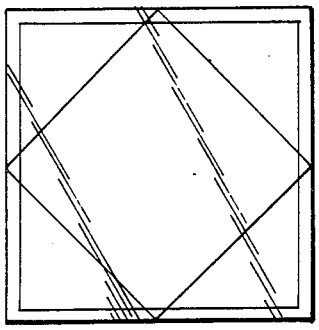
FIG. 26
FIG. 25
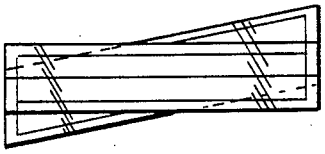
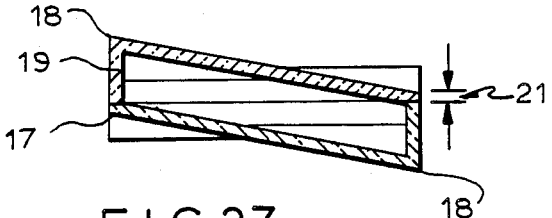
FIG. 27
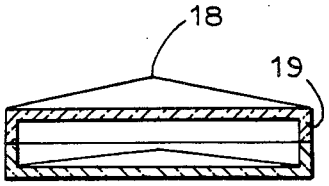
FIG. 28

DECORATIVE, FUNCTIONAL ELEMENT FOR CONSTRUCTION AND THE LIKE

This invention pertains to an article of commerce in the form of a square which on one face of the square carries a multiple of surfaces for the purpose of enhancing the visual appearance of a wall, a floor, a ceiling, a roof or the like. More particularly, this invention pertains to an article of manufacture which is suitable for creating a number of variations in visual appearance due to the almost infinite variety of optical interplays of the various surfaces, creating a great variety of visual effects and optical illusions in three-dimensional space. Still further, this invention pertains to a construction element which employs lighted, shaded, and shadowed areas based on the arrangement of these construction elements. The result is surfaces which either intersect or present discontinuities creating optical, visual effects ranging from extremely subtle to starkly accentuated. These effects, at the same time, optically present illusions which upon further viewing change.

BACKGROUND FOR THE INVENTION

In the construction of various surfaces to achieve decorative effects, two- or three-dimensional surfaces have been created such as on floor tiles. By varying the colors of the various tiles and by changing the arrangement of the size and/or orientation, various effects are achieved. For example, these effects range from the mosaic appearance, that is, non-ordered, to completely ordered symmetrical effects. Further, floor tiles have carrried various patterns which have created some optical illusions. For the most part, floor tiles have been two-dimensional or have used color and contrast for creating different appearances, i.e., such as in the Roman mosaics and the like.

Further, three-dimensional visual effects have also been created in these two-dimensional tiles, such as by imparting variously alternating wavy lines giving the appearance of a three-dimensional, wavy surface.

For facades, e.g., for building, walls, etc., or for interior surfaces, three-dimensional surfaces have been created by having building blocks formed of threedimensionally raised and lowered surfaces or even hollow passages, thereby creating a pleasing or striking visual appearance.

Furthermore, terra cotta construction has been employed to give exquisite details to building facades. Some of these have had a glazed surface which has created further distinguishing features, such as in color and light.

In general, the three-dimensional repeating structures that have been created have found acceptance, but for a single common element in the basic building or construction element there have been limited possibilities for creating a varied visual appearance attributable to the interplay of the light on the surfaces.

Still further, the limited application of the interplay has been based on the difficulty in assembling intricate, three-dimensional patterns, since it is difficult for the worker or artist optically to relate these patterns by working with these in such a manner as not to commit errors in the assembling or errors when using the material in building a structure.

Although almost any surface reflects light, in a manner, if it has a different angle of incidence from a surface next to it, this effect can further be enhanced if the intersections of these surfaces are presented in such a form as to cause reflection, shadow, or shade refraction in almost infinite varieties. To wit, this principle is being used such as in cut glass, i.e., crystal manufacture and shaping, and this principle has often been employed with striking results, such as in the cut crystals or chandeliers that employ this principle. However, the assembling of almost an infinite variety of structures based on only one or at most two faces of a single element is not known to the inventor.

BRIEF DESCRIPTION OF THE PRESENT INVENTION

In construction and decoration and for enhancing the appearance of a surface, namely—a surface such as a floor, ceiling or wall, be it interior or exterior, various visual appearances are now created by selecting a standard element. This element is three-dimensional, and it relies on creating visual effects and appearances based on the orientation of a number of specifically related surfaces on one or two faces of a square element. For purposes of construction, almost in infinite variety of surface appearances may be created by the appropriate placement and orientation of a single square element and its relationship to each adjoining or juxtapositioned square elements, all of which are preferably in a pattern of a square (although these may also be produced in multiples of the single square element). Moreover, this invention pertains to the discovery that these articles of manufacture may be varied from having a very subtle appearance to a very stark appearance in terms of shaded, shadowed and lighted areas. When employing two three-dimensional, opposite faces such as in glass blocks or acrylic blocks, and added three-dimensional effect is achieved.

By lighted areas it is meant, for the disclosed element, areas on which the light impinges directly; by shaded areas it is meant where a diffused light plays on a surface, and by shadowed areas it is meant areas where a surface of a three-dimensional element either casts a distinct shadow or another surface or surfaces.

This definition is employed with reference to a single light source. When multiple light sources are directed on the exposed surfaces of the novel element, different effects appear.

The visual appearance of the elements is such that with different incidental light, there is a subtle and constant interplay of the light striking the surfaces. These changes occur in an almost kaleidoscopical manner as the light plays on the surface of the novel element, for example, sunlight on the exterior of the building as the sun ascends and descends during the course of the day.

Furthermore, by having the surfaces arranged in almost an infinite variety, a great number of patterns may be created which may take on various effects as the light strikes each of the patterns. Thus a domain may be created of these elements arranged in one form, and adjacent to it a domain may be created where the elements are arranged in another form. Because the arrangement is based on a square element which has a number of surfaces, the almost infinite variety of the domains are also possible within an overall surface. At the same time, assembly of these elements in each domain is very easy by appropriate rotation, offsetting and juxtapositioning of these elements and the finishing of the boundary regions.

Typically for the present invention, the elements have equilateral sides and have five surfaces on which one is in a plan view a square, and the others are fractions of the same square, again in a plan view. Furthermore, by dividing this square with five surfaces in four sections, mirror image sections may be created which, upon orientation, become identical. Two of these four subsections can then be used to complete any border portion or boundary area of the surface which needs to be completed. Moreover, also the bisecting of the surface, that is by dividing the surface with a straight line and creating two equal portions, a rectangular section may be created which also may be used for completing the boundary areas of a surface which is being finished with these elements, such as for the above-mentioned different domains.

However, for purposes of construction and ease of assembling including the ready production, it has been found most convenient to use a square element which has five surfaces in plan view of the two subunits thereof that have four surfaces in plan view. These and other variations and applications of these surfaces will be further explained herein.

Still further, each of the surfaces for any given application may be further distinguished by color reflection or refraction properties of the surface of any combination of these to achieve further the infinite varieties in which these elements can be combined.

DETAILED DESCRIPTION OF THE INVENTION, THE EMBODIMENTS THEREOF AND THE DRAWINGS THEREOF

In presenting the invention and the various elements thereof, the reference is made to the drawings, wherein:

FIG. 1 is an isometric view of a terra cotta facing of the novel article;

FIG. 2 is a top plan view of the face of the terra cotta article shown in FIG. 1;

FIG. 3 is an upper edge plan view of FIG. 2 of the article;

FIG. 4 is a lower edge plan view of the article shown in FIG. 2;

FIG. 5 is a plan view of the right-hand side of the article shown in FIG. 2;

FIG. 6 is a plan view of the left-hand side of the article shown in FIG. 2;

FIG. 7 is a bottom view of the article shown in FIG. 1;

FIG. 8 is a cross sectional view of the article shown along cross section lines 8—8 of FIG. 2;

FIG. 9 is a cross sectional view of the article shown along cross section lines 9—9 of the article in FIG. 2;

FIG. 13 is an isometric view of a further embodiment of this invention, namely—a concrete block;

FIG. 14 is a top view of the block shown in FIG. 13;

FIG. 15 is a front plan view of the block shown in FIG. 13;

FIG. 16 is a right-hand plan view of the block shown in FIG. 13;

FIG. 17 is a left-hand plan view of the block shown in FIG. 13;

FIG. 18 is a cross sectional view along lines 18 of FIG. 14;

FIG. 19 is a cross sectional view of the block shown in FIG. 15 along cross sectional lines 19;

FIG. 20 is an isometric view of a glass construction block;

FIG. 21 is a plan view of one of the faces of the glass block shown in FIG. 20;

FIG. 22 is a plan view of the top edge shown in FIG. 20;

FIG. 23 is a plan view of the bottom edge shown in FIG. 20;

FIG. 24 is a plan view of the left-hand side of the article shown in FIG. 20;

FIG. 25 is a right-hand plan view of the article shown in FIG. 20;

FIG. 26 is a bottom view of the article shown in FIG. 20;

FIG. 27 is a cross sectional view along cross sectional lines 27—27 of FIG. 21;

FIG. 28 is a cross sectional view along the cross sectional line 28 of FIG. 21.

Figure 11:
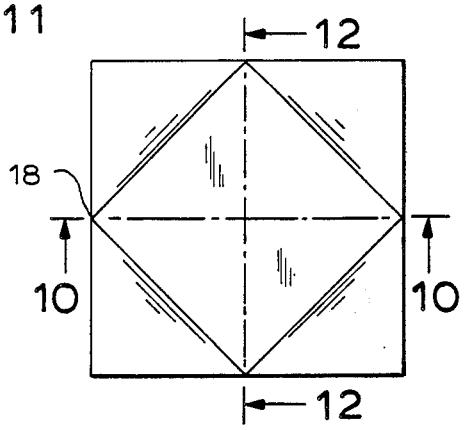
FIG. 11 shows a plan view of the article shown in FIG. 1 with the cross sectional lines 10—10 as an imaginary line and 12—12 which illustrate the cross sections and the angular relationship and spacial relationship for a novel article.
Figure 12:
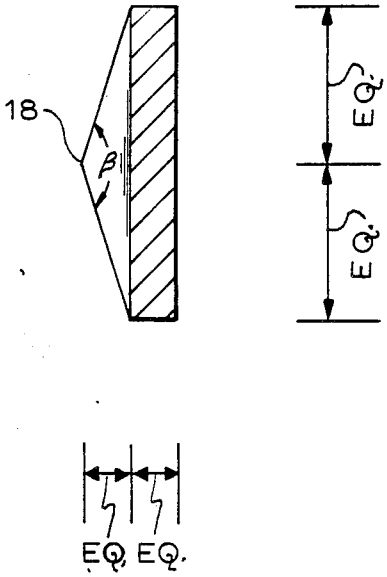
FIG. 12 shows the cross sectional and spacial relationship of the article shown in FIG. 11 along cross sectional lines 12 and the angles thereof, including the distances thereof.

As previously discussed, a terra cotta article of manufacture has been shown in FIGS. 1 to 9. The principle for the use of the decorative element has been explained in FIGS. 10 to 12. A concrete block embodiment has been shown in FIGS. 13 to 19, and a two-faced glass block in FIGS. 20 to 28.

The description of terra cotta materials is found in publications such as *Terra Cotta* by Landmarks Preservation Council of Illinois, 407 So. Dearborn Street, Chicago, Ill. 60605, 1984.

Olin et al., "Construction, Principles, Materials and Methods", 3rd Ed., The Institute of Financial Education, Chicago, Ill., 1975, describe concrete block, masonry wall, and ceramic tile finishes, as well as glass block usage. Hence, the description of the various materials from which the novel element can be made may be found in literature readily available.

Turning now to the Figures, FIG. 1 is an isometric view of the element 3 shown for purposes of illustration as a terra cotta facing suitable for a building surface such as for an exterior building surface.

In FIG. 2, the surfaces on the square element 3 are five in number and have been labeled as 11 to 15.

In FIG. 3, the relationship of these surfaces is illustrated by the following. Edge 16 defines the zero elevation plane of the element; point 17 in FIG. 1, and also as indicated in FIGS. 2 and 3 and elsewhere in the drawings, defines the minus one point of the element, and point 18 defines the plus one point of the element 3. These may also be expressed as planes, but as these are points, these have been labeled as such, i.e., 17 and 18. Thus line 16 defines the zero elevation plane of the element 3 with point **16*a*, 17 and 18 being in the middle of the square element 3 and equidistant from each corner 7** for the respective points along the respective edges of the element.

For example, for line 16 the point **16*a* is equidistant from each of the corners of the element shown in FIG. 1**.

For easy understanding, all of the various points and lines for each of the elements have been shown in each of the figures with the same numbers and identified accordingly.

The plan view of the back surface of the terra cotta facing shown in FIG. 7 illustrates the typical construction of a terra cotta facing with the rim 19 defining the surface which is abuttingly affixed to a wall and the backside of surfaces 11 to 15.

With reference to FIG. 8, the same cross section appears also along the section line 8—8 in FIG. 2, and the corresponding rim has been identified as 19.

Although point 17 may rest directly on the surface in terra cotta construction such as for anchoring purposes and the like, the surfaces are raised by an adequate increment such as illustrated by the distance identified with the numeral 21.

Turning now to FIGS. 3 and 4, if one of the two elements 3 is rotated 180 degrees vis-a-vis another element 3, i.e., where point 18 of one coincides with point 17 of the other element, then one of the elements 3 rotated and placed on top of the other will form a square block, i.e., a top surface of one of the elements will matingly rest on the top surface of the other and be secure for transportation and storage. Consequently, these surfaces may be readily protected vis-a-vis each other. For transportation purposes, these lockingly interact and are thus securedly moved from the supply location or on the construction site.

As these square elements are repeatable, the storage and/or transportation advantages are readily apparent therefrom.

As it is clearly evident from FIGS. 13 to 19, element 3 may be part of a concrete block 6 as one face thereof, or may be as thin as a floor tile.

Figure 10:
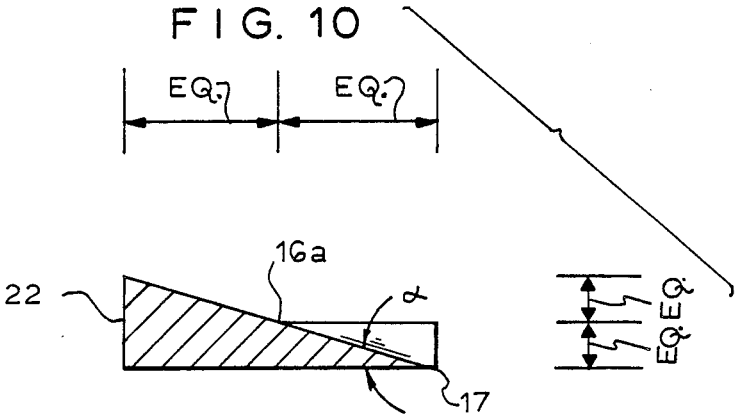
FIG. 10 illustrates the angular and equidistant relationships of the various surfaces and points on the element shown in FIG. 1 and along cross sectional lines 10 of FIG. 11.

An angle alpha shown in FIG. 10 thus may be from almost zero (but not zero) to a maximum of tending towards 90°.

For practical purposes, however, an angle alpha greater than 45° makes these blocks more difficult to manufacture and/or transport. An angle alpha of 45° will define a perfect cube for two blocks mated face to face if there is no raised portion such as 21 illustrated in FIG. 8. An interior angle beta shown in FIG. 12 on one edge of the element is further used to define these blocks. For example, for the block in which alpha is 45° on surface 22 shown in FIG. 1, the angle beta about point 18 is 90°. A complementary angle 17*a* in FIG. 5 for point 17 will, together with angle beta, define 360°.

An embodiment which utilizes various possibilities of an element where alpha is 45° and beta is 90° will be further described herein.

Likewise an angle beta such as 120° around point 18 allows the formation of a series of hexagonal repeats if the element 3 is placed on edge 22.

When these elements are placed on edge 22, thus various other shapes may be obtained, for example for the element where the angle alpha is 45° and the angle beta about point 18 is 90°, a square arrangement may be obtained. These possibilities further enhance the ability of element 3 to function, not only when it is laid flat on its back surface such as when it is laid on rim 19, but also when it is laid on edge 22. For this purpose, however, the point 17 must not be offset, such as by the offset amount 21 shown in FIG. 8.

Turning now to the further description of the element 3, when it is placed on a side such as shown in FIG. 10, the edge 22 as previously mentioned must be two units high vis-a-vis the reference point 17. One of the intersection points 16*a* thus defines one equal unit.

As it is evident from FIGS. 1 and 2, each of the surfaces 11 to 15 may also carry different colored glazing and/or different reflective coatings. Thus a multiple of variations are possible on each of the surfaces. An assembly of these in a wide variety of combinations having an almost infinite variety of surface texture possibilities are evident.

Turning now to the previously mentioned illustration where the angle alpha is 45° and the angle beta about point 18 is 90°, when the element with such angles is placed on edge 22, four of these blocks will define in the interior thereof a square in a plan view. That is, viewing down from the top, the upper edges, that is the edge 23 opposite to edge 22, will form a square in the interior surfaces thereof, defined each corner with point 17. The figure will resemble a cross in the form of a "Red Cross". Again, these assemblies can then be used in a number of runs such as on a wall or a ceiling. Accordingly, these will form an appropriate wall covering projecting only towards the viewer a multiple of squares and a form of "Red Cross".

Similarly, when the angle beta that is about point 18 defines 120° and the elements are placed on the edge 22, then a hexagonal will be formed by three of the elements and a series of hexagonals will be formed with each assembly of three with a hexagonal void space therebetween. The hexagonal void space will be equivalent to two elements 3 placed back to back.

Consequently, if in the void space then two elements are placed back to back, that is, where points 17 area against each other and points 18 are opposite to each other, a void space precursor for a hexagonal is partially formed with the adjacent hexagonal element unit.

As it is evident from the above discussion, these varieties then provide a great freedom for creating surface effects with elements that function both as building blocks, as decorative tiles, glass blocks or floor tiles and the like. For floor tiles, the angle of alpha in FIG. 10, of course, will be very small, and the floor tile surface may then appropriately be filled to make a rectangular flat shape after it has been laid. On surfaces 11 to 15, when an epoxy or polyurethane polymer is used to cover these, it creates a flat and pleasing yet visually three-dimensional effect. These tiles may be pre-formed with epoxy coating or the epoxy resin may be poured in place.

A further illustration in FIGS. 20 to 28 has been shown for a glass block with two opposite faces. These are useful for construction of separations and for creating various light effects. Typically glass blocks are hollow and are made in two parts. Thereafer the two parts are joined together. Edge rim 19 shown in FIG. 27 in relation to spacing 21 likewise shown in FIG. 27, for the glass blocks may be of the appropriate dimensions to make the two-sided glass block 9 of the selected thickness depending on the load bearing necessity. Of course, when the two-sided arrangements such as for glass block 6 are used in hot pressing or forming transparent or initial plastic sheets, the pressings allow production and assembly (in various configurations) of plastic sheets of square configuration and of great variety, again for the reason that all repeat units will be of the same size. Boundary conditions as previously described may also be employed.

Thus while previously some of these effects have been sought to be achieved with two-dimensional elements, the present invention allows the achievement of three-dimensional surfaces with far greater optical vibrancy and optically pleasing appearances which can be tailored from the most subtle to stark and contrasting and visually having a tremendous impact on the viewer. The further advantage of the various optical illusions that can now be created three-dimensionally provide great freedom in selecting, not only for the appropriate light conditions the incidence of the light, but creating an enormous variety in surfaces which heretofore have been rather uninteresting.

Various arrangements of these elements, if photographed with light at different incidence and different viewer location, produce strikingly beautiful surface effects. These photographs, especially if taken in black and white where only a white element 3 is used, or in color where different colors and elements are used, point out beautifully the interaction of these elements with light.

Thus in the creation of these effects, great use is made of the surfaces themselves such as surfaces 11 to 15, the surface intersections, because of the different angular relationship of the surfaces to the other at varying angles alpha and beta, and the offsetting of the various elements vis-a-vis others to introduce surface discontinuities. By surface discontinuities is meant a surface which vis-a-vis its next adjoining surface has a 90° intersection with the base of the element 3 laid on the surface sought to be covered.

In addition to the above illustrations when the half or quarter elements are used for finishing edges or boundaries, these may also be used to make a transition from a pattern to a pattern for a domain of different patterns.

In the finishing operation, the one quarter of the tile elements are best used for that purpose because these are symmetrical about lines 24 or lines 25 shown in FIGS. 1 and 2.

The material which may be usefully employed for this purpose may be ceramic materials, plaster of Paris, fiberglass, resin or polymers such as acrylics, polyesters, reinforced resins, metals such as steel, aluminum and the like which may be further surface coated. Ceramic tiles may be fired to further use these either in their fired state or with glazes and with a variety of colors for the glazes.

Similarly, plaster of Paris may be used in natural form or painted or surface treated and the like.

As previously mentioned, the floor tiles may be of ceramic bottom and epoxy top, giving a translucent solid top and a solid bottom, where the surfaces of 11 to 15 may be of any color. Thereafter these may be laid in epoxy and the seams finished with epoxy resin and the like.

Decorative paneling may also be obtained accordingly which may be also fiberglass, reinforced plastic, as well as metal and steel aluminum. These materials may be made in various sizes to suit the various conditions.

The materials may also be hollow, such as the terra cotta illustration shown in FIGS. 1 to 9 and the glass blocks of FIGS. 20 to 28, and again of various sizes such as from two inches to two feet when used as exterior decorating surface elements for walls. Similarly, metals such as steel or aluminum as well as fiberglass, reinforced plastics, vinyls, ABS and the like may be used as suitable for interior or exterior applications. For transparent effects as well, polyacrylic resins or glass and the like may be employed. For example, acrylic and glass material may be in any color or shading. These blocks are illustrated by those embodiments shown in FIGS. 13 to 19 and FIGS. 20 to 28.

Load bearing exterior or interior decorative blocks are likewise used, such as concrete blocks 6 shown in FIGS. 14 to 20, with the surface being as defined for the elements above and the spacing 21 as shown in FIG. 8 being of the necessary thickness for the load bearing purposes. These may be hollow or solid, but preferably with hollows 6*a* as it is well known, and these may be natural, painted or glazed, such as when made from various forms of concrete described by Olin et al., supra. Again, the sizes of these are typically varied such as for the concrete blocks 6 within the 8 by 8 by 8 specification, or any other variation as long as the requisite unit relationship obtains for the surface of it which is exposed to a viewer.

Further possibilities exist such as for roof coverings and other coverings or claddings and the varieties as previously mentioned. Other possibilities exist in providing toy and game blocks for entertaining children, such as made from plastic, ABS plastic and the like.

Although these illustrations are indicative, there are many other variations, and the invention as disclosed herein is applicable to these variations without restricting the same to any particular embodiment.

What is claimed is:

1. As an article of manufacture, a surface covering for a wall, a floor, a ceiling, a partition and the like comprising a three-dimensional body having a rectangular base and further defined by:

(a) a zero plane through the body parallel to the base;

(b) a minus elevation point with respect to the zero plane;

(c) a plus elevation point with respect to the zero plane; said minus and plus elevation points equidistant in plus and minus elevation from said zero plane;

(d) a pair of first midpoints on said zero plane equidistant from two opposite edges of said body, one midpoint at one edge and midpoint at the other edge;

(e) a pair of second midpoints, one midpoint at said minus elevation point and the other midpoint located at the plus elevation point equidistant from two other opposite edges of said zero plane; each of the midpoints of the second pair of midpoints being equidistant from the zero plane; all of said midpoints located on a plane that intersects said zero plane at the first pair of midpoints, said body having a rear face extending from said base to said plus elevation point defining with the plus elevation point and zero plane a triangle, said body having a front face which includes the minus elevation point and two mirror image triangles, said body having two rectangular side faces which extend from the base to the zero plane.

2. As an article of manufacture, an array of the repeated runs of the individual articles as defined in claim 1.

3. An article of manufacture, wherein a subunit of the article defined in claim 1, divided by a straight line in either two or four subunits whereby the line is drawn through said pair of first midpoints and/or through said pair of second midpoints, is an edging for said array or as finishing bouundaries for said array.

4. The article of manufacture as defined in claim 1, wherein an angle between the base and intersecting at minus elevation point and plus elevation point is greater than zero but less than 45 degrees.

5. The article of manufacture as defined in claim 1, wherein the interior angle of about the plus elevation point on the interior thereof is less than 90 degrees but more than 45 degrees.

6. The article of manufacture as defined in claim 1, wherein an angle about the plus elevation point on the interior thereof is 120 degrees.

7. The article of manufacture as defined in claim 1, wherein the angle between the base and intersecting with minus elevation point and plus elevation point is 45 degrees.

8. An article of manufacture as defined in claim 1, wherein the same is a floor tile with an epoxy covering parallel to said zero plane and of a sufficient thickness for wear purpose above the plus elevation point.

9. The article of manufacture as defined in claim 1, wherein the same is a glass block.

10. The article of manufacture as defined in claim 1, wherein the same includes a unitary rectangular platform for said base.

11. The article of manufacture as defined in claim 1, wherein the same is a terra cotta facing for a building or a terra cotta construction element.

12. As an article of manufacture comprising a plurality of arrays of an article as defined in claim 1.

* * * * *